US009566781B2

(12) United States Patent
Takeuchi et al.

(10) Patent No.: US 9,566,781 B2
(45) Date of Patent: Feb. 14, 2017

(54) TRANSFER-TYPE IMAGE RECORDING METHOD

(71) Applicant: CANON KABUSHIKI KAISHA, Tokyo (JP)

(72) Inventors: Keiichirou Takeuchi, Komae (JP); Masaki Nitta, Yokohama (JP); Toru Ohnishi, Yokohama (JP); Takao Ogata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/148,204

(22) Filed: May 6, 2016

(65) Prior Publication Data

US 2016/0332438 A1 Nov. 17, 2016

(30) Foreign Application Priority Data

May 15, 2015 (JP) ..... 2015-099776

(51) Int. Cl.
*B41J 2/005* (2006.01)

(52) U.S. Cl.
CPC ..... *B41J 2/0057* (2013.01)

(58) Field of Classification Search
None
See application file for complete search history.

(56) References Cited

U.S. PATENT DOCUMENTS 4,777,492 A 10/1988 Ohnishi et al.
5,100,468 A 3/1992 Yuasa et al.
8,052,271 B2 11/2011 Kunimine et al.
8,362,108 B2 * 1/2013 Imai ..... C09D 11/324 523/160
9,180,658 B2 * 11/2015 Kanasugi ..... B41J 2/0057
2011/0269885 A1 * 11/2011 Imai ..... C09D 11/324 524/376
2014/0368593 A1 * 12/2014 Kanasugi ..... B41J 2/0057 347/103

FOREIGN PATENT DOCUMENTS

JP 2009-051118 A 3/2009

OTHER PUBLICATIONS

Sep. 15, 2016 European Search Report in European Patent Appln. No. 16001069.0.

* cited by examiner

*Primary Examiner* — An Do
*Assistant Examiner* — Renee I Wilson
(74) *Attorney, Agent, or Firm* — Fitzpatrick, Cella, Harper & Scinto

(57) ABSTRACT

A transfer-type image recording method including the steps of applying a treatment liquid that causes aggregation of a component contained in ink to an image formation surface of an intermediate transfer member; applying ink to the surface to form an intermediate image; transferring the image from the surface to an recording medium; and applying an aqueous cleaning liquid to the surface. The treatment liquid contains a nonionic surfactant. In the step of applying a treatment liquid, $T1<Tc1$ is satisfied, where T1 and Tc1 are respectively the temperature and cloud point of the treatment liquid. In the step of applying an aqueous cleaning liquid, $T2>Tc2$ is satisfied, where T2 is the temperature of a liquid mixture, formed on the surface, of a remainder of the treatment liquid and the aqueous cleaning liquid, and Tc2 is the cloud point of the liquid mixture.

7 Claims, 4 Drawing Sheets

TRANSFER-TYPE IMAGE RECORDING METHOD

BACKGROUND OF THE INVENTION

Field of the Invention

The present invention relates to a transfer-type image recording method using a treatment liquid and an ink.

Description of the Related Art

As an image recording method using an ink, a transfer-type image recording method has been known. By the method, an ink is applied to an image formation surface of an intermediate transfer member to form an intermediate image, and the intermediate image is transferred to a recording medium.

In the transfer-type image recording method, the fixation of an intermediate image formed with an ink proceeds on an intermediate transfer member, and thus the method enables stable image formation even when a recording medium having low ink absorbability or a recording medium having a small ink absorption capacity is used. For example, when a thin paper having a small water absorption capacity used in the commercial printing field is used to record an image by an ink jet method, damages such as cockling and curling may be caused to the paper itself. Even for such a thin paper, when the fixation of an intermediate image is allowed to proceed on an intermediate transfer member and then the image is transferred to the thin paper, the image in which the generation of cockling or curling is suppressed can be recorded.

In the transfer-type image recording method, an image recording method using two liquids of a treatment liquid and an ink has been known. The treatment liquid has a function of causing aggregation of components contained in an ink. Application of the treatment liquid causes aggregation of the ink applied to an intermediate transfer member to promote the fixation of an intermediate image.

As for typical coating of a treatment liquid, the whole of an ink image as an intermediate image formed by application of ink drops on an intermediate transfer member, that is, an area larger than the size of an ink image is preferably coated with a treatment liquid in order to certainly achieve the aggregation effect to the margin of the ink image. In this case, the treatment liquid coating film formed on an intermediate transfer member includes an area where the treatment liquid comes in contact or is mixed with the film of an ink and reacts with the ink to increase the viscosity and an area where the treatment liquid does not come in contact with the ink film and does not contribute to the viscosity increasing reaction. The area having a higher viscosity forms an intermediate image, which is transferred to a recording medium. At the time of transfer, most of the area that does not come in contact with the ink film and does not contribute the viscosity increasing reaction is not transferred to a recording medium and is left on the intermediate transfer member.

When an intermediate transfer member is reused (in other words, an intermediate image is transferred from an intermediate transfer member to a recording medium, and then another intermediate image is formed once again on the intermediate transfer member after the transfer), the surface of the intermediate transfer member after the transfer of an intermediate image is cleaned to remove the remainders such as a treatment liquid left on the intermediate transfer member. However, if a treatment liquid having high wettability with respect to an intermediate transfer member is used, the treatment liquid cannot be completely removed even by cleaning in some cases. If an intermediate transfer member on which a treatment liquid is left is coated with the treatment liquid once again, the coating state of the treatment liquid becomes uneven, and thus the treatment liquid coating film formed on the intermediate transfer member have various thicknesses in some cases. Such a variation in the thickness of the treatment liquid coating film causes a variation in the size of dots formed from ink drops applied to the treatment liquid coating film, and affects precise formation of an intermediate image, in some cases.

As measures against the above-described problem relating to cleaning, Japanese Patent Application Laid-Open No. 2009-51118 discloses an ink jet recording method in which on an intermediate transfer member a first release agent, a second release agent as a treatment liquid, and ink dots are applied in this order to form an image and a cleaning step after image transfer is performed in the following conditions.

Cleaning temperature>$Tg$ of first release agent>transfer temperature>$Tg$ of second release agent In Japanese Patent Application Laid-Open No. 2009-51118, the temperature is controlled in such a way that only the second release agent becomes in a flowable state at the time of transfer and then the first release agent layer also becomes in a flowable state at the time of cleaning. On this account, by removing the first release agent layer from the intermediate transfer member at the time of cleaning, the reaction liquid and the ink can be removed together with the first release agent layer even if left on the first release agent layer, and thus insufficient cleaning can be suppressed according to this method.

SUMMARY OF THE INVENTION

A transfer-type image recording method of the present invention includes the steps of:

applying a treatment liquid that causes aggregation of a component contained in an ink to an image formation surface of an intermediate transfer member, applying an ink to the image formation surface to which the treatment liquid is applied to form an intermediate image, transferring the intermediate image from the image formation surface to a recording medium, and applying an aqueous cleaning liquid to the image formation surface after the transfer of the intermediate image.

In the transfer-type image recording method, the treatment liquid contains a nonionic surfactant.

In the step of applying a treatment liquid, the following Expression (1) is satisfied:

$$T1<Tc1 \quad (1)$$

where T1 is a temperature of the treatment liquid applied to the image formation surface, and Tc1 is a cloud point of the treatment liquid.

In the step of applying an aqueous cleaning liquid, the following Expression (2) is satisfied:

In the step of applying an aqueous cleaning liquid, the following Expression (2) is satisfied:

$$T2>Tc2 \quad (2)$$

where T2 is a temperature of a liquid mixture, formed on the image formation surface, of a remainder of the treatment liquid and the aqueous cleaning liquid, and Tc2 is a cloud point of the liquid mixture.

According to the present invention, a transfer-type image recording method capable of satisfying both good coatability of a treatment liquid on an intermediate transfer member and good cleanability of the intermediate transfer member can be provided without an increase in the number of steps.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

For apparatuses that perform transfer-type image recording as well, economical apparatuses are demanded, for example, on the basis of downsizing of an apparatus by a reduction in the number of steps or a reduction in the number of component units and of a reduction in the cost of consumables. The present invention has an object to provide a transfer-type image recording method capable of satisfying both good coatability of a treatment liquid on an intermediate transfer member and good cleanability of the intermediate transfer member without an increase in the number of steps.

Embodiments of the present invention will now be described in detail.

The term "recording medium" not only includes paper used for common printing but also widely includes fabrics, plastics, films, other printing media, and recording media.

Image Formation Apparatus

Figure 1:
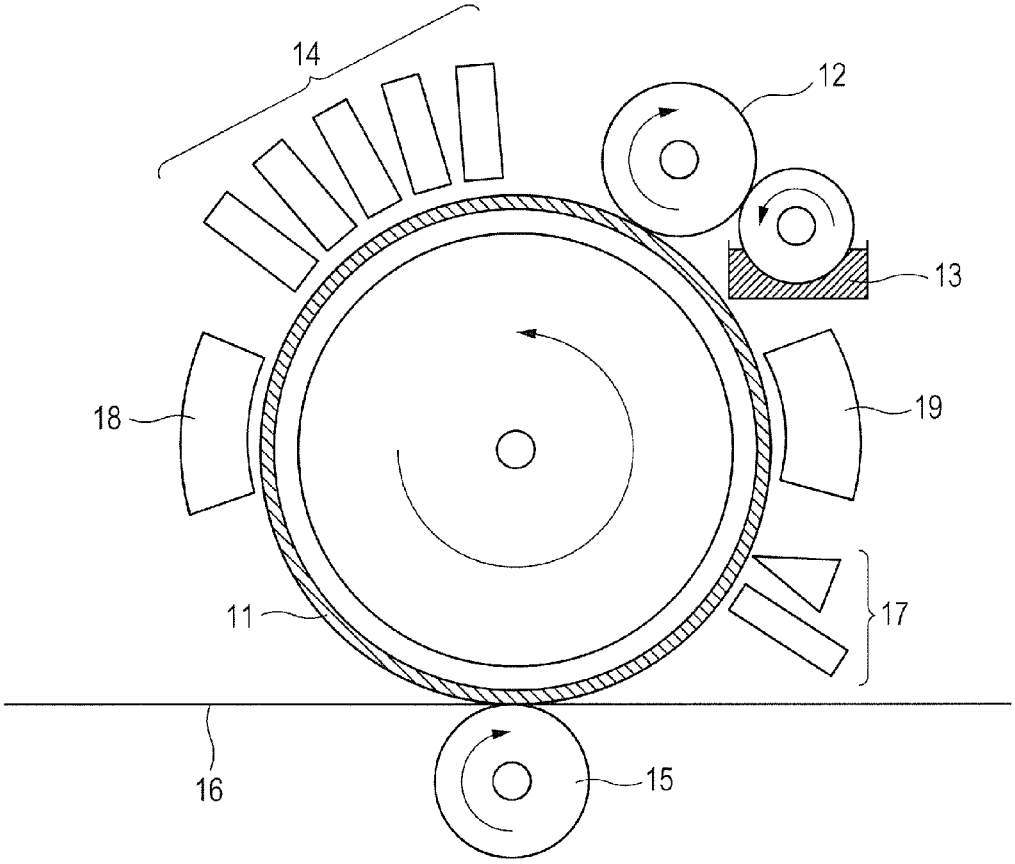
FIG. 1 is a view illustrating an example of an apparatus for transfer-type image recording.

FIG. 1 is a schematic view of an apparatus for transfer-type image recording in an embodiment of the present invention, viewed from a side face.

An intermediate transfer member 11 is supported on a support member on a rotatable cylinder. The support member is rotationally driven in the arrow direction around an axis as the center. Each device arranged around the intermediate transfer member works in such a way as to be synchronized with the rotation of the support member.

First, an image formation surface of the intermediate transfer member 11 is coated with a treatment liquid 13 by using a coating roller of a roller type treatment liquid coating unit 12 as a treatment liquid application unit. Hereinafter, the step of applying a treatment liquid to an image formation surface of an intermediate transfer member is also called a treatment liquid coating step. The treatment liquid contains a component that causes aggregation of components contained in an ink and a nonionic surfactant for giving a cloud point effect.

When the intermediate transfer member 11 arrives at the position of an ink jet recording head (hereinafter referred to as recording head) 14, an ink is ejected from the recording head 14 and reacts with the treatment liquid 13 previously applied onto the intermediate transfer member 11 to cause an increase in viscosity thereof, forming an ink image as an intermediate image. When the ink image arrives at the position of a roller type transfer unit 15, the ink image on the intermediate transfer member 11 is transferred to a recording medium 16 by utilizing the heat and pressure of the transfer roller. When the image formation surface after the transfer of the intermediate image passes through a cleaning unit 17, the remainder such as the treatment liquid left on the image formation surface is removed. Specifically, the cleaning unit 17 includes an aqueous cleaning liquid application member that applies an aqueous cleaning liquid to the image formation surface of the intermediate transfer member and a removal member that removes a liquid mixture of the remainder of the treatment liquid and the aqueous cleaning liquid. The step of applying the aqueous cleaning liquid to the image formation surface of the intermediate transfer member and then removing the liquid mixture of the remainder of the treatment liquid and the aqueous cleaning liquid is also referred to as a cleaning step, hereinafter.

The image formation surface treated with the cleaning unit 17 is repeatedly subjected to the above steps, and image recording on the recording medium 16 can be continuously performed.

The temperature of the surface of the intermediate transfer member can be uniformly controlled by temperature adjustment with a temperature controller provided inside the support member.

In the present invention, the temperature T1 of the treatment liquid applied to the image formation surface and the cloud point Tc1 of the treatment liquid satisfy Expression (1) in the step of applying a treatment liquid to the image formation surface of the intermediate transfer member. In the step of applying an aqueous cleaning liquid, the temperature T2 of the liquid mixture, formed on the image formation surface, of the remainder of the treatment liquid and the aqueous cleaning liquid and the cloud point Tc2 of the liquid mixture of the remainder of the treatment liquid and the aqueous cleaning liquid satisfy Expression (2).

$$T1<Tc1 \quad (1)$$

$$T2>Tc2 \quad (2)$$

T1: Temperature of the treatment liquid applied to the image formation surface

Tc1: Cloud point of the treatment liquid

T2: Temperature of the liquid mixture of the remainder of the treatment liquid and the aqueous cleaning liquid formed on the image formation surface Tc2: Cloud point of the liquid mixture of the remainder of the treatment liquid and the aqueous cleaning liquid The temperature (T1) of the treatment liquid applied to the image formation surface can be determined by measuring the temperature at the position of the intermediate transfer member 11 immediately after the contact with a coating roller of the treatment liquid by using a thermoviewer, a noncontact thermometer, or a similar device. The temperature (T2) of the liquid mixture, formed on the image formation surface, of the aqueous cleaning liquid and the remainder of the treatment liquid can also be determined by measuring the temperature at the position of the intermediate transfer member 11 immediately after the application of the aqueous cleaning liquid with the cleaning unit 17, in the same manner as for T1. Alternatively, these temperatures can also be estimated by common thermal fluid simulation.

The temperature control method of controlling T1 and T2 is exemplified by a method of applying an aqueous cleaning liquid with a temperature higher than the cloud point (Tc1) of a treatment liquid in the cleaning step and a method of changing the temperature of the intermediate transfer member between the treatment liquid coating step and the cleaning step.

The method of changing the temperature of the intermediate transfer member between the treatment liquid coating step and the cleaning step is exemplified by a method of controlling the temperature by using an image recorder including a heater 18 as a heating unit and/or a cooler 19 as a cooling unit as shown in FIG. 1. When a transfer roller with a heating unit is used, the heating unit of the transfer roller can also be used as the heater for temperature control in the cleaning step depending on a heating temperature at the time of transfer in some cases. A heater capable of heating the surface of the intermediate transfer member for cleaning after the transfer of an intermediate image can also be provided singly or in combination with at least one of the above-mentioned heaters.

After the image formation surface of the intermediate transfer member 11 passes the recording head 14, a heater 18 is used to perform heating, and after it passes through the cleaning unit 17, a cooler 19 is used to perform cooling until the image formation surface arrives at the position of the roller type treatment liquid coating unit 12 once again. The cooling of the intermediate transfer member 11 by the cooler 19 is performed in such a way as to set a temperature condition satisfying Expression (1) in the treatment liquid coating step, and the heating of the intermediate transfer member 11 by the heater 18 is performed in such a way as to set a temperature condition satisfying Expression (2) in the cleaning step.

As the heater, heaters such as a hot-air heater and a flash heater by infrared condensation can be used. As the cooler 19, a cooler by laser cooling and a cooler by impinging jet cooling can be used.

In order to form a good image, T1 is preferably 50° C. or more and 70° C. or less. For the same reason, T1<T2 is preferred.

Figure 2:
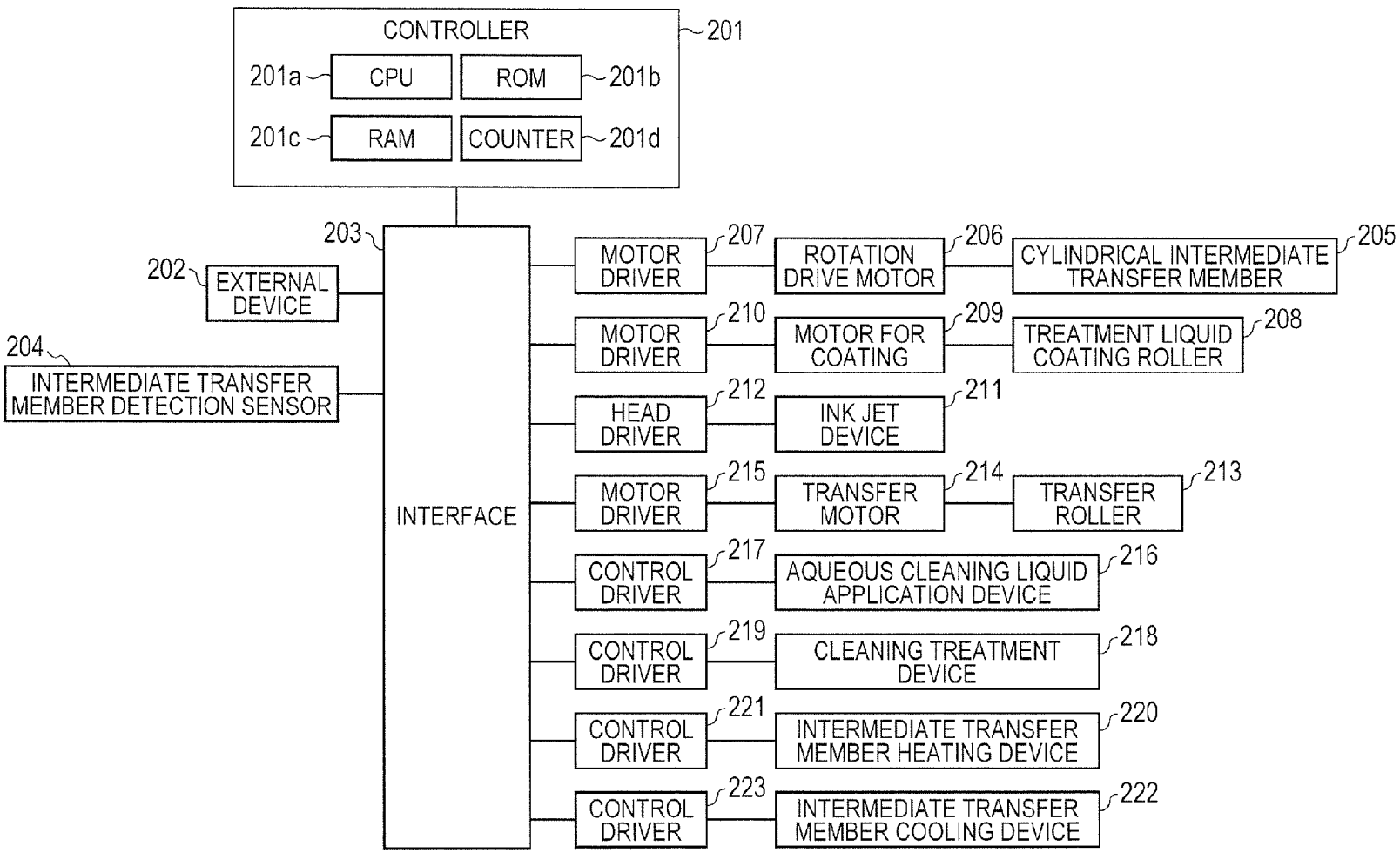
FIG. 2 is a block diagram of a control system for transfer-type image recording pertaining to an embodiment of the present invention.

FIG. 2 shows a block diagram of a control system in this embodiment.

A controller 201 that sends drive control signals of each device includes a CPU 201*a*, a ROM 201*b*, a RAM 201*c*, and a counter 201*d*.

The CPU 201*a* is a central processing unit and reads out programs or various data from the ROM 201*b* and the like, performs requested calculation and decision, and performs various controls. The ROM 21*b* is a read-only memory and stores various programs for the operation of the CPU 201*a*, character codes, and various data required for dot pattern recording and the like. The RAM 201*c* is a read/write memory and includes, for example, a working area for temporarily storing data under processing by the CPU 201*a* and calculation results and a buffer area for storing various data input through an external device 22 or the like. To the controller, image signals are input from an external device 202 and intermediate transfer member detection signals are input from an intermediate transfer member detection sensor 204, through a control interface 203.

The controller 201 performs the following processing based on a program.

(a) A driving signal is output to a motor driver 207 for driving a rotation drive motor 206 that is for rotating a cylindrical support member 205 for rotation movement of an intermediate transfer member.

(b) A driving signal is output to a motor driver 210 for driving a motor for coating 209 to rotate a coating roller 208 that is for applying a treatment liquid onto the intermediate transfer member 11 in the roller type treatment liquid coating unit 12.

(c) A driving signal is output to a head driver 212 for driving an ink jet device 211 that is for ejecting an ink through the recording head 14.

(d) A driving signal is output to a motor driver 215 for driving a motor 214 that is for rotating a transfer roller 213 in the roller type transfer unit 15.

(e) A driving signal is output to a control driver 217 for driving a device 216 that applies an aqueous cleaning liquid in the cleaning unit 17 onto the intermediate transfer member.

(f) A driving signal is output to a control driver 219 for driving a cleaning treatment device 218 that is for removing a liquid mixture of an aqueous cleaning liquid and a treatment liquid as drainage.

(g) A driving signal is output to a control driver 221 for driving a device 220 as the heater 18 in heating the intermediate transfer member 11.

(h) A driving signal is output to a control driver 223 for driving a cooling device 222 as the cooler 19 in cooling the intermediate transfer member 11.

Figure 3:
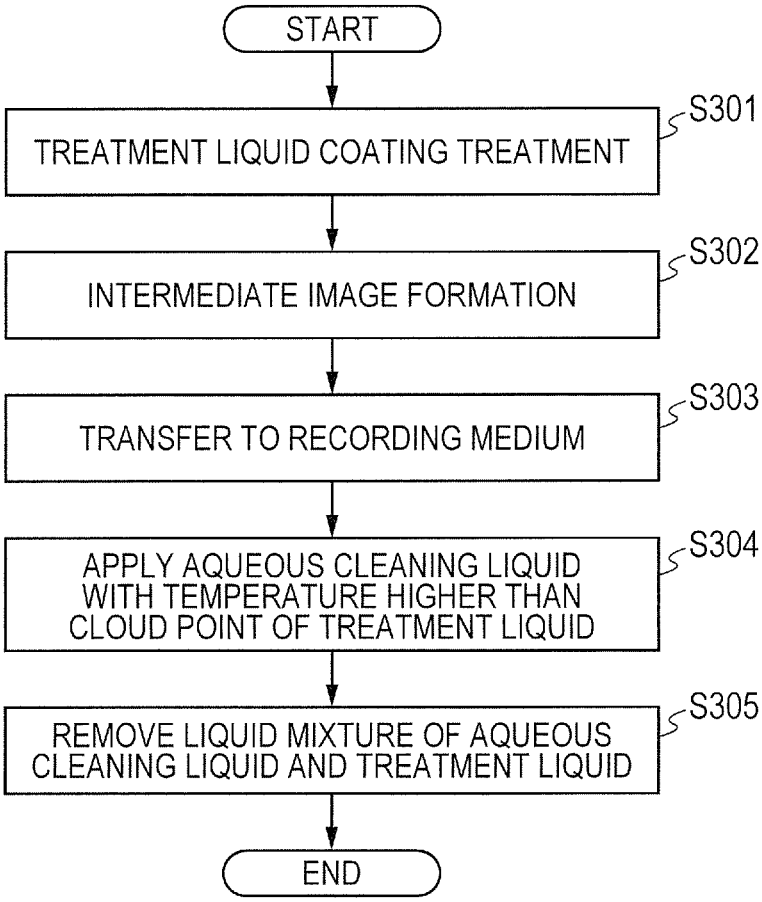
FIG. 3 is a workflow chart of a cleaning step pertaining to an embodiment of the present invention.
Figure 4:
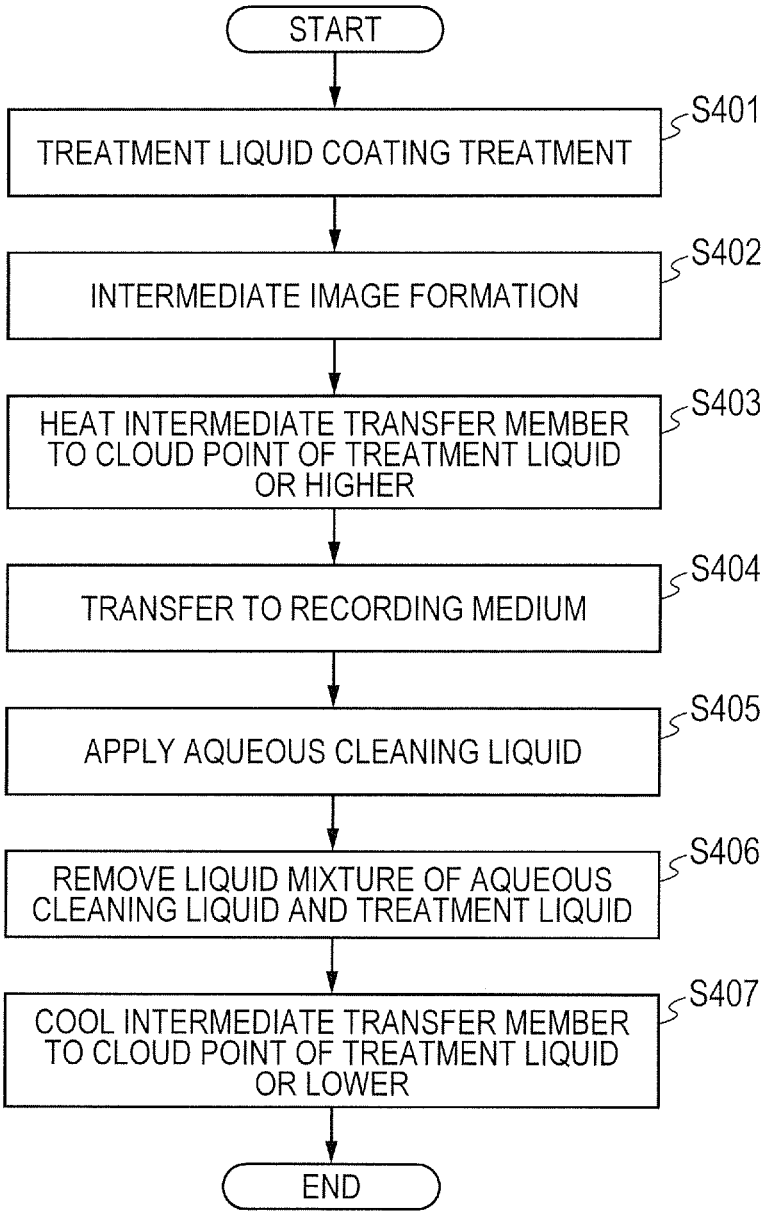
FIG. 4 is a workflow chart of temperature control of an intermediate transfer member surface pertaining to an embodiment of the present invention.

FIG. 3 and FIG. 4 show workflow charts in this embodiment, for performing temperature control to satisfy Expression (1) and Expression (2) mentioned above.

FIG. 3 shows a workflow of the unit for applying an aqueous cleaning liquid with a temperature (T2) not lower than the cloud point (Tc1) of the treatment liquid in the cleaning step.

In S301, a treatment liquid is applied onto an intermediate transfer member to perform treatment liquid coating on the intermediate transfer member; and in S302, a plurality of nozzles provided on a recording head are driven in response to a recording signal and an ink is ejected to form an intermediate image. In S303, the intermediate image is transferred to a recording medium; in S304, an aqueous cleaning liquid with a temperature (T2) higher than the cloud point (Tc1) of the treatment liquid is applied; and in S305, a liquid mixture of the treatment liquid left on the intermediate transfer member and the water-containing liquid (aqueous cleaning liquid) is removed.

FIG. 4 shows a workflow in the cleaning step of changing the temperature of an intermediate transfer member between the treatment liquid coating step and the cleaning step.

In S401, a treatment liquid is applied onto an intermediate transfer member to perform treatment liquid coating on the intermediate transfer member; and in S402, a plurality of nozzles provided on a recording head are driven in response to a recording signal and an ink is ejected to form an intermediate image. In S404, the intermediate transfer member is heated to a temperature not lower than the cloud point (Tc1) of the treatment liquid, and then the intermediate image is transferred to a recording medium. In S405, an aqueous cleaning liquid is applied; in S406, a liquid mixture of the treatment liquid left on the intermediate transfer member and the aqueous cleaning liquid is removed as drainage; and in S407, the temperature of the intermediate transfer member is reduced to a temperature lower than the cloud point (Tc1) of the treatment liquid to perform cooling treatment.

By performing the workflows in FIG. 3 and FIG. 4, the effect of the invention can be obtained.

The method of performing the temperature control for satisfying Expression (1) and Expression (2) may be any method other than the above two unit.

The cleaning step may be performed every time or may be intermittently performed so as not to cause image defects such as a variation of dots.

The schematic view of the transfer-type image recorder in an embodiment of the present invention, the block diagram of the control system, and two workflows are indicated hereinbefore, and the requirements for performing each step will next be described in detail.

Intermediate Transfer Member

An intermediate transfer member has an image formation surface that holds a treatment liquid, serves as a substrate for forming an intermediate image, and is for forming an intermediate image. The intermediate transfer member can have a structure including a support member for handling the intermediate transfer member and for conveying a required force and a surface layer member having the image formation surface. The support member and the surface layer member may be integrated using the same material. The support member and the surface layer member may be formed from a plurality of independent members.

The surface layer member can be formed from a material capable of forming an intermediate image formation surface that enables the formation of an intermediate image and the transfer of the intermediate image to a recording medium.

The shape of the intermediate transfer member is exemplified by a sheet shape, a roller shape, a drum shape, and a belt shape. When a belt-shaped intermediate transfer member is used as an endless belt, the same intermediate transfer member can be continuously, repeatedly used, and thus such a structure is particularly preferred in terms of productivity.

The size of the intermediate transfer member can be freely selected in accordance with an intended print image size. The support member of the intermediate transfer member is required to have such a structural strength that the support member can be used as the intermediate transfer member from the viewpoint of the transfer accuracy and the durability thereof. The material of the support member is preferably metals, ceramics, and resins, for example. Specifically, aluminum, iron, stainless steel, an acetal resin, an epoxy resin, polyimide, polyethylene, polyethylene terephthalate, nylon, polyurethane, silica ceramics, and alumina ceramics are particularly preferably used in terms of the rigidity capable of withstanding the pressure at the time of transfer, dimensional accuracy, and characteristics required to reduce the inertia during operation to improve the control responsivity. It is also preferred to use these materials in combination.

The surface layer member of the intermediate transfer member preferably has an elasticity required for transferring an image by pressing it against a recording medium such as paper. When paper is used as the recording medium, the hardness of the surface layer member of the intermediate transfer member is preferably a durometer A hardness of 10 to 100° and particularly preferably 20 to 60° (in accordance with JIS K6253).

As the material of the surface layer member, various materials such as polymers, ceramics, and metals can be used. As the material of the surface layer member, various rubber materials and elastomer materials are preferably used from the viewpoint of process characteristics and the above-mentioned elastic properties. For example, preferred are polybutadiene rubbers, nitrile rubbers, chloroprene rubbers, silicone rubbers, fluororubbers, urethane rubbers, styrene elastomers, olefin elastomers, polyvinyl chloride elastomers, ester elastomers, and amide elastomers. In addition, polyether, polyester, polystyrene, polycarbonate, siloxane compounds, and perfluorocarbon compounds can also be suitably used, for example. Specifically, nitrile-butadiene rubber, silicone rubber, fluororubber, and urethane rubber are particularly preferably used in terms of dimensional stability, durability, heat resistance, and the like.

Also preferred are surface layer members having a multilayer structure prepared by laminating a plurality of layers made from different materials as shown below.

- A two-layer structure prepared by covering a urethane rubber layer with a silicone rubber layer.
- A two-layer structure prepared by laminating a silicone rubber layer on a polyethylene terephthalate (PET) film layer.
- A two-layer structure prepared by forming a film of a polysiloxane compound on a urethane rubber layer.

A sheet prepared by infiltrating a rubber material such as nitrile-butadiene rubber and urethane rubber into a cotton fabric or a woven fabric such as polyester fabric and rayon fabric as a base fabric can also be suitably used as the surface layer member.

The intermediate image formation surface of the surface layer member may be subjected to an appropriate surface treatment. Examples of such a surface treatment include flame treatment, corona treatment, plasma treatment, polishing treatment, roughening treatment, active energy ray (UV, IR, RF, for example) irradiation treatment, ozone treatment, surfactant treatment, and silane coupling treatment. These treatments are also preferably performed in combination. Between the surface layer member and the support member, various adhesives, double-sided adhesive tapes, and the like may be interposed in order to fix and hold these members.

Treatment Liquid

The treatment liquid contains water, an ink-viscosity-increasing component, and a nonionic surfactant. Increasing the ink viscosity includes the case in which a coloring material, a resin, or the like in an ink chemically reacts or physically adsorbs upon contact with an ink-viscosity-increasing component, and accordingly a viscosity increase of the whole ink is observed, and also includes the case in which some of components such as a coloring material are aggregated to locally cause a viscosity increase.

By a viscosity increase, an ink can be settled at an intended position on an intermediate transfer member, and a high definition image can be formed. As the ink-viscosity-increasing component, a metal ion, a polymer aggregating agent, and other substances capable of giving an intended aggregation effect by ink-viscosity-increasing can be selected and used. Specifically preferred are polyvalent metal ions and organic acids as the substance causing a change in pH of an ink to cause aggregation. A plurality of types of ink-viscosity-increasing components can also be preferably contained.

Examples of the organic acid include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, oxysuccinic acid, and dioxysuccinic acid.

In the present invention, the treatment liquid contains a nonionic surfactant and thus has a cloud point (Tc1). The cloud point is such a temperature that phase separation is caused between a liquid and a solute at the cloud point or higher to reduce the surface activating power. Accordingly, if a treatment liquid is applied to an intermediate transfer member in a temperature condition lower than the cloud point (Tc1), high wettability of the image formation surface of the intermediate transfer member with the treatment liquid can be obtained by the surface activating effect of the nonionic surfactant in a dissolved state, and a coating film of the treatment liquid can be effectively formed. To use the cloud point effect, the treatment liquid is required to contain a nonionic surfactant. From the viewpoint of uniform coating of a treatment liquid in order to form a good intermediate image, for example, a fluorinated nonionic surfactant is more preferred in order to impart high wettability with the treatment liquid to the image formation surface of an intermediate transfer member.

The fluorinated nonionic surfactant is exemplified by CAPSTONE (registered trademark) FS-30, FS-31, FS-3100, FS-34, FS-35, FS-60, FS-61, FS-63, FS-64, FS-300, FSN, FSN-100, FSO, and FSO-100 manufactured by Du Pont Co., MEGAFACE 144D, F444, and TF2066 manufactured by Dainippon Ink and Chemicals, Inc., Surflon S-141, -145, and -241 manufactured by ASAHI GLASS CO., LTD., and FTERGENT 251 manufactured by Neos Company Ltd.

If the temperature is the cloud point or higher, the phase separation is caused between a liquid and a solute and the treatment liquid becomes opaque. In the present invention, the cloud point is determined as a temperature at which a treatment liquid put in a sealed measurement cell has a transmittance of 50% or less. The cloud point mainly depends on the type of a surfactant contained in a solution. For example, the cloud point (Tc1) of a treatment liquid can be adjusted to 80° C. when F444 is used as the nonionic surfactant and to 50° C. when TF2066 is used.

The content of the nonionic surfactant in the treatment liquid can be set so as to give a cloud point effect depending on the type of a nonionic surfactant on which the cloud point effect mainly depends. As for the proportions of an ink-viscosity-increasing component, a fluorinated nonionic surfactant, and water in the treatment liquid containing the fluorinated nonionic surfactant, the proportion of the ink-viscosity-increasing component is preferably 30 to 50 parts by mass, the proportion of the fluorinated nonionic surfactant is preferably 1 to 10 parts by mass, and the proportion of water is preferably 40 to 69 parts by mass (100 parts by mass in total) from the viewpoint of ink viscosity increase, good coatability of a treatment liquid, and the like.

Treatment Liquid Application

For coating of the treatment liquid, methods with conventionally known various coating unit can be used. Examples of the coating method include die coating, blade coating, coating methods using gravure rollers, coating methods using offset rollers, and spray coating.

As the method of applying a treatment liquid to an intermediate transfer member, an application method by an ink jet method can be used.

One of or a combination of two or more of unit selected from the above coating unit can be provided in a transfer-type image recorder as the treatment liquid coating unit.

When a treatment liquid is applied to the image formation surface of an intermediate transfer member, temperature control is performed so as to satisfy the above-mentioned condition of Expression (1).

Intermediate Image Formation

By applying an ink to the image formation surface of an intermediate transfer member, an intermediate image is formed. At the time of this application, an ink is applied in such a way as to at least partly overlap with an area where the treatment liquid is applied. To apply an ink to an intermediate transfer member, various ink application unit can be used. As the ink application unit, an ink jet device (ink jet recording apparatus) can be suitably used.

The ink ejection system of a recording head of the ink jet device is exemplified by the following systems.

- A system in which film boiling of an ink is caused by an electrothermal converter to form bubbles to eject the ink.
- A system in which an ink is ejected by an electromechanical converter.
- A system in which an ink is ejected by using static electricity.

Specifically, the system using an electrothermal converter is particularly preferably used from the viewpoint of high-density printing at high speed.

The operation manner of the recording head is not limited to particular manner. For example, what is called a shuttle type ink jet head in which a head is scanned in a direction orthogonal to the moving direction of an intermediate transfer member to form an intermediate image or what is called a line-head type ink jet head in which ink ejection orifices are arranged in a linear manner substantially orthogonal to the moving direction of an intermediate transfer member (i.e., substantially parallel with the axis direction for a drum-shaped intermediate transfer member) can be used.

The size and the formation area of an intermediate image are preferably smaller than the application area of a treatment liquid on the intermediate image formation surface of an intermediate transfer member. This is because an ink is allowed to react with a treatment liquid certainly up to the edge portion of an intermediate image.

Ink

As the ink, an ink containing a component that is aggregated by a treatment liquid and having a formulation required for the formation of an intermediate image that is transferred to a recording medium is used.

When an ink is applied to an intermediate transfer member by an ink jet method, inks widely used as the ink jet ink can be used. Specifically, various inks in which a coloring material such as a dye, carbon black, and an organic pigment is dissolved and/or dispersed in a liquid medium can be used. Of them, a pigment ink containing carbon black, an organic pigment, or the like as the coloring material gives an image having good weatherability and color developability and thus is preferred. To further improve the effect achieved by the combination with a treatment liquid, the ink preferably contains an anionic polymer. If the anionic polymer undergoes aggregation reaction with a treatment liquid, aggregation solidification is caused to promote the fixation of an intermediate image.

The anionic polymer may be any anionic polymers that can be used as a component of an ink and has a functional group having a minus charge (anionic group). In order to improve the effect achieved by the combination of a treatment liquid, a polymer having an anionic group such as a carboxylic acid group, a sulfonic acid group, a phosphonic acid group, or a group formed by neutralization of them with a metal salt or an organic amine is preferred. The polymer having an anionic group is preferably an acrylic polymer and a urethane polymer having a carboxyl group. Such an anionic polymer is contained in an ink preferably as a dispersant for a pigment which is a coloring material and/or as a functional additive.

Components of the pigment ink will next be described.

Pigment

The coloring material in an ink, that is, the pigment as the coloring agent component, is not limited to particular pigments, and known black pigments and known organic pigments can be used. Specifically, pigments indicated by color index (C.I.) numbers can be used. As the black pigment, carbon black is preferably used.

In terms of the dispersion manner in the ink, self-dispersible pigments and pigments dispersed by a dispersant are exemplified, and one of or a combination of two or more of them can be used. The content of the pigment in the ink is preferably 0.5% by mass or more and 15.0% by mass or less and more preferably 1.0% by mass or more and 10.0% by mass or less relative to the total mass of the ink.

Dispersant

The dispersant for dispersing a pigment may be any dispersant usable in an ink jet ink. Specifically, a water-soluble dispersant having both a hydrophilic moiety and a hydrophobic moiety in the molecular structure thereof is preferably used. In particular, a water-soluble resin dispersant composed of a resin prepared by copolymerization of a mixture containing at least a hydrophilic monomer and a hydrophobic monomer is preferably used. As the hydrophilic group, the above-mentioned anionic group having a minus charge is used in order to achieve the effect of the present invention. Each monomer used here is not limited to particular monomers, and any monomer capable of giving a water-soluble resin having an intended function as the dispersant can be used. Specifically, examples of the hydrophobic monomer include styrene, styrene derivatives, alkyl (meth)acrylates, and benzyl (meth)acrylate. Examples of the hydrophilic monomer include acrylic acid, methacrylic acid, and maleic acid.

The dispersant preferably has an acid value of 50 mg KOH/g or more and 200 mg KOH/g or less. The dispersant preferably has a weight average molecular weight of 1,000 or more and 50,000 or less. The ratio of the pigment and the dispersant is preferably in a range of 1:0.1 to 1:3. If the anionic polymer on which the treatment liquid acts is used as the water-soluble resin dispersant, the acid value and the weight average molecular weight thereof are also preferably selected from these ranges.

What is called a self-dispersible anionic pigment that is dispersible due to surface modification of a pigment itself without use of a dispersant is also preferably used in the present invention. If the self-dispersible anionic pigment is used without the dispersant, an anionic polymer is added to the pigment ink as an additive other than the dispersant. Such an additive is exemplified by the above-mentioned anionic polymers that are also usable as the dispersant and resin particles having an anionic group described later.

Resin Particles

The pigment ink can contain colorless resin particles having no coloring material, such as resin particles, as an additive. Specifically, resin particles may have the effect of improving image quality or fixability and thus are preferred.

The resin particles are not limited to particular resin particles, and one kind or two or more kinds of resin particles formed of such a material and having such a particle diameter as can be used for forming an intended image can be selected and used.

The material of the resin particles is specifically exemplified by homopolymers such as polyolefin, polystyrene, polyurethane, polyester, polyether, polyurea, polyamide, polyvinyl alcohol, poly(meth)acrylic acid and salts thereof, polyalkyl (meth)acrylates, and polydienes; and copolymers prepared by copolymerizing a plurality of monomers of them in combination.

In order to more effectively promote aggregation reaction by a viscosity increasing component in the treatment liquid and to improve the ejection performance of a recording head, the content of the resin particles in the pigment ink is preferably 1% by mass or more and 50% by mass or less and more preferably 2% by mass or more and 40% by mass or less relative to the total mass of the pigment ink.

The resin particles are preferably contained in a dispersed state in the liquid medium of the pigment ink.

The dispersion form of the resin particles in the pigment ink is not limited to particular forms, but self-dispersible resin particles and dispersant-dispersion resin particles are preferred. The self-dispersible resin particles can be prepared by homopolymerization of a monomer having a dissociable group or by copolymerization of a plurality of such monomers. The dissociable group is exemplified by a carboxyl group, a sulfonic acid group, and a phosphoric acid group, and the monomer having the dissociable group is exemplified by acrylic acid and methacrylic acid. This allows resin particles to have an anionic group. If an anionic polymer is contained in the form of self-dispersible resin particles in a pigment ink, self-dispersible resin particles having an anionic group are used.

The dispersant-dispersion resin particles can be dispersed in an ink if a dispersant is used in combination. Even if self-dispersible resin particles are used, a dispersant can be used in combination. The dispersant for dispersing resin particles such as an emulsifier may be any emulsifier having a low molecular weight or a high molecular weight and capable of achieving an intended resin particle dispersion effect. As such an emulsifier, a surfactant can be used, and a nonionic surfactant or a surfactant having the same charge as that of resin particles is preferred. If resin particles having an anionic group are used, an anionic surfactant is preferred.

The resin particles are preferably microparticles having a dispersion particle diameter of 10 nm or more and 1,000 nm or less and more preferably microparticles having a dispersion particle diameter of 100 nm or more and 500 nm or less.

At the time of preparation of a pigment ink, the resin particles are preferably used in the form of a resin particle dispersion in which resin particles are dispersed in a liquid (for example, an aqueous medium such as water). When a resin particle dispersion is prepared, various additives are also preferably added for stabilization. The additive for the stabilization is preferably n-hexadecane, dodecyl methacrylate, stearyl methacrylate, chlorobenzene, dodecyl mercaptan, olive oil, a blue dye (Blue 70), and polymethyl methacrylate, for example.

Surfactant

The pigment ink may contain a surfactant. The surfactant is specifically exemplified by Acetylenol EH (manufactured by Kawaken Fine Chemicals Co.) and Adeka Pluronic (manufactured by ADEKA Corporation). The content of the surfactant in the pigment ink is preferably 0.01% by mass or more and 5.0% by mass or less relative to the total mass of the pigment ink.

Water and Water-Soluble Organic Solvent

The pigment ink is prepared by using at least a pigment as the coloring material and a liquid medium as the dispersion medium of the pigment. As the liquid medium, water and/or an organic solvent can be used. The ink jet ink is preferably an aqueous pigment ink containing an aqueous liquid medium as the liquid medium.

As the aqueous liquid medium, water or a mixture of water and a water-soluble organic solvent can be used, for example. The water is preferably a deionized water prepared by ion exchange, for example. The content of the water in an aqueous pigment ink is preferably 30% by mass or more and 97% by mass or less relative to the total mass of the aqueous pigment ink.

The type of the water-soluble organic solvent is not limited to particular types, and any organic solvent usable in an ink jet ink can be used. The water-soluble organic solvent is specifically exemplified by glycerol, diethylene glycol, polyethylene glycol, and 2-pyrrolidone. At least one of the water-soluble organic solvents can be used. The content of the water-soluble organic solvent in an aqueous pigment ink is preferably 3% by mass or more and 70% by mass or less relative to the total mass of the aqueous pigment ink.

Other Additives

The aqueous pigment ink may contain various additives such as pH adjusters, anticorrosives, antiseptic agents, antifungal agents, antioxidants, reduction inhibitors, surface control agents, water-soluble resins and neutralizers thereof, and viscosity modifiers, in addition to the above components as necessary.

Transfer

The transfer of an intermediate image formed on the intermediate transfer member to a recording medium is performed as follows: a recording medium is brought into contact with an intermediate image on the intermediate transfer member under a pressure required for the transfer; and the intermediate image is released from the intermediate transfer member and concurrently transferred to the recording medium side.

As the transfer unit, any transfer unit having a structure enabling a transfer step can be used in accordance with the shape of the intermediate transfer member.

For example, a transfer unit including a pressure roller can be suitably used. To further promote the fixation by drying of an image or to improve the transferability when a resin component capable of being softened by heat is used to form an intermediate image, a pressure roller including a heating unit for heating at the time of transfer can be suitably used. For the pressure roller having a heating unit, a heater is preferably placed inside the pressure roller for temperature control at the time of transfer. The heater may be arranged at a part inside the pressure roller but is preferably arranged all over the peripheral surface inside the pressure roller. The heater is preferably capable of variously controlling the temperature of the pressure roller surface from 25° C. to 200° C.

As a transfer roller of the roller type transfer unit 15 in the apparatus shown in FIG. 1, a heating pressure roller having the above-mentioned structure can be used. In the apparatus shown in FIG. 1, the intermediate transfer member 11 also functions as a support roller. By inserting a stacked portion of the intermediate transfer member 11 and the recording medium 16 interposing an intermediate image therebetween into a nip portion formed of the support roller and the transfer roller, the stacked portion is pressurized from both sides under heating, and the image can be efficiently transferred.

Cleaning

In the cleaning step of the present invention, the image formation surface of the intermediate transfer member after the transfer of an intermediate image to a recording medium is cleaned with an aqueous cleaning liquid. The cleaning step includes a step of applying an aqueous cleaning liquid to the image formation surface of the intermediate transfer member and a step of removing at least the aqueous cleaning liquid and a remainder of the treatment liquid from the intermediate transfer member.

In the cleaning step, an aqueous cleaning liquid is applied to the image formation surface after the transfer of an intermediate image, and then temperature control is performed in such a way that the aqueous cleaning liquid and the remainder of the treatment liquid satisfy the previously-mentioned condition of Expression (2).

The cloud point effect mainly depends on the type of a nonionic surfactant as described above. Hence, as for the cloud point (Tc2) of the liquid mixture in Expression (2), a premeasured cloud point (Tc1) of the treatment liquid can be used as Tc2 if the aqueous cleaning liquid contains no substance that changes the cloud point of the treatment liquid (for example, nonionic surfactants and salts that differ from those in the treatment liquid). Alternatively, a liquid mixture of the treatment liquid and the aqueous cleaning liquid is prepared at a mixing ratio expected to be that at the time of cleaning, and the cloud point of the liquid mixture is determined in accordance with the above-mentioned measurement of light transmittance and can be used as Tc2.

If an aqueous cleaning liquid contains a component affecting the cloud point of a treatment liquid (for example, nonionic surfactants and salts that differ from those in the treatment liquid), the cloud point (Tc2) of the liquid mixture may differ from the cloud point (Tc1) of the treatment liquid. Even in such a case, a liquid mixture of the treatment liquid and the aqueous cleaning liquid is prepared at a mixing ratio expected to be that at the time of cleaning, and the cloud point of the liquid mixture is determined in accordance with the measurement of light transmittance and can be used as Tc2.

Under the temperature condition of Expression (2), the surface activating power of the nonionic surfactant contained in the treatment liquid is inactivated to reduce the wettability of the intermediate transfer member due to the treatment liquid, and thus the intermediate transfer member is likely to repel the liquid mixture of the remaining treatment liquid and the aqueous cleaning liquid. As a result, the adhesiveness of the liquid mixture of the remaining treatment liquid and the aqueous cleaning liquid with respect to the intermediate transfer member is reduced, and thus the treatment liquid and the aqueous cleaning liquid can be easily removed from the intermediate transfer member.

The method of setting the temperature condition of Expression (2) is exemplified by the following methods.

(i) An aqueous cleaning liquid with a temperature higher than the cloud point (Tc1) of the treatment liquid is applied to a cleaning surface of the intermediate transfer member to adjust the temperature of the liquid mixture of the remaining treatment liquid and the aqueous cleaning liquid on the intermediate transfer member to a temperature higher than Tc1. In other words, the cloud point (Tc1) of the treatment liquid and the temperature (T3) of the aqueous cleaning liquid satisfy Expression (3):

$$T3>Tc1 \quad (3)$$

(ii) An aqueous cleaning liquid is applied to a cleaning surface of the intermediate transfer member, and then the cleaning surface of the intermediate transfer member is adjusted to a temperature higher than Tc1.

The temperature (T2) of the liquid mixture of the remainder of the treatment liquid and the aqueous cleaning liquid on the intermediate transfer member in the cleaning step is made 10° C. or more higher than the cloud point (Tc2) of the liquid mixture of the remainder of the treatment liquid and the aqueous cleaning liquid. In other words, the cleaning is preferably performed in the temperature condition satisfying the relation of Expression (4).

$$T2-Tc2\geq 10^\circ\ \mathrm{C.} \quad (4)$$

The cloud point (Tc2) is a temperature at which a nonionic surfactant starts to be inactivated. If the condition of Expression (3) is satisfied, the surface activating power is more markedly reduced, and the removal performance of the treatment liquid is further improved. The temperature of the treatment liquid and the aqueous cleaning liquid on the intermediate transfer member in the cleaning step is a temperature when the liquid mixture left on the intermediate transfer member is removed after application of the aqueous cleaning liquid.

Aqueous Cleaning Liquid

As the aqueous cleaning liquid in the present invention, water or an aqueous solution containing water and a water-soluble organic solvent can be used. The type of the water-soluble organic solvent for the aqueous cleaning liquid is not limited to particular types, and one of or a combination of two or more of water-soluble organic solvents capable of giving an intended cleaning effect can be used. For example, the water-soluble organic solvent is exemplified by water-soluble organic solvents usable as the aqueous liquid medium in the pigment ink.

As for the water-soluble organic solvent, the following water-soluble organic solvents are preferred from the viewpoint of moisture retaining properties and miscibility with the treatment liquid, for example.

Alkyl alcohols having 1 to 4 carbon atoms, such as methyl alcohol, ethyl alcohol, n-propyl alcohol, isopropyl alcohol, n-butyl alcohol, sec-butyl alcohol, and tert-butyl alcohol; amides such as dimethylformamide and dimethylacetamide; ketones and ketoalcohols such as acetone and diacetone alcohol; ethers such as tetrahydrofuran and dioxane; polyalkylene glycols such as polyethylene glycol and polypropylene glycol; alkylene glycols having alkylene groups with 2 to 6 carbon atoms, such as ethylene glycol, propylene glycol, butylene glycol, triethylene glycol, 1,2,6-hexanetriol, thiodiglycol, hexylene glycol, and diethylene glycol; lower alkyl ether acetates such as polyethylene glycol monomethyl ether acetate; glycerol; lower alkyl ethers of polyhydric alcohols, such as ethylene glycol monomethyl (or ethyl) ether, diethylene glycol methyl (or ethyl) ether, and triethylene glycol monomethyl (or ethyl) ether; and N-methyl-2-pyrrolidone, 2-pyrrolidone, 1,3-dimethyl-2-imidazolidinone, and the like.

One of or a combination of two or more of solvents selected from the above solvents can be used.

If the water-soluble organic solvent is used, the content in the aqueous cleaning liquid can be selected from the range of 3 to 50% by mass.

The aqueous cleaning liquid can further contain at least one of additives such as nonionic surfactants and salts, as necessary.

The salts having a cloud point reduction function is exemplified by sodium salts such as sodium dihydrogen phosphate, disodium hydrogen phosphate, trisodium phosphate, tetrasodium pyrophosphate, sodium dihydrogen pyrophosphate, sodium tetraphosphate, and sodium hexametaphosphate; potassium salts such as potassium dihydrogen phosphate, dipotassium hydrogen phosphate, tripotassium phosphate, tetrapotassium pyrophosphate, potassium tripolyphosphate, and potassium metaphosphate; ammonium salts such as ammonium dihydrogen phosphate and diammonium hydrogen phosphate; and calcium salts such as calcium dihydrogen phosphate, calcium monohydrogen phosphate, and tripotassium phosphate. One of or a combination of two or more of salts selected from the above salts can be used. The content can be selected from the range of 5 to 10% by mass.

The nonionic surfactant may be any nonionic surfactant that achieves an improvement effect of the cleanability due to the cloud point effect. For example, a surfactant capable of achieving an intended effect can be selected from known nonionic surfactants and used. From the viewpoint of preservability of the aqueous cleaning liquid, a fluorinated nonionic surfactant is preferred as with the treatment liquid because such a surfactant provides high wettability and good miscibility with the treatment liquid, for example. Specific examples include the fluorinated nonionic surfactants exemplified in the above description of the treatment liquid.

The content of the nonionic surfactant is preferably 1 to 10% by mass from the viewpoint of preservability and wettability.

Cloud Point of Liquid Mixture of Treatment Liquid and Aqueous Cleaning Liquid

In such a condition that the image formation surface of the intermediate transfer member has high wettability with the treatment liquid and the treatment liquid has high adhesiveness to the image formation surface, the transferability of the treatment liquid itself to a recording medium is relatively reduced, and the treatment liquid applied to an area with no image on the image formation surface is left on the image formation surface after the transfer step. If a treatment liquid having high wettability with the image formation surface of the intermediate transfer member is used, the remaining treatment liquid adhering to the image formation surface cannot be easily removed in some cases.

If the aqueous cleaning liquid is applied to the treatment liquid left on the intermediate transfer member in the cleaning step, the content (% by mass) of the nonionic surfactant contained in the liquid mixture of the treatment liquid and the aqueous cleaning liquid is reduced, but the cloud point itself is mainly controlled by the type of a surfactant and basically depends on the kind of the nonionic surfactant contained in the treatment liquid. Thus, if the aqueous cleaning liquid does not contain a component that lowers the cloud point of the treatment liquid, the cloud point of the liquid mixture of the treatment liquid and the aqueous cleaning liquid after the application of the aqueous cleaning liquid is considered to be approximately equal to the cloud point of the treatment liquid, and the temperature on the image formation surface can be accordingly set at the time of cleaning.

If the treatment liquid left on the intermediate transfer member is mixed with at least part of the aqueous cleaning liquid in the above temperature condition, the cleaning effect by utilizing the cloud point effect can be obtained.

If the aqueous cleaning liquid contains a different type of nonionic surfactant which is different from that in the treatment liquid, the cloud point of the liquid mixture of them mainly depends on two surfactants of the nonionic surfactant in the treatment liquid and the nonionic surfactant in the aqueous cleaning liquid.

As described above, the aqueous cleaning liquid can contain a salt. By using an aqueous cleaning liquid containing a salt, the salt is added to the treatment liquid left on the intermediate transfer member, and the cloud point thereof can be reduced. This can reduce the temperature of the intermediate transfer member at the time of cleaning. This is caused by a change in the solubility itself of a nonionic surfactant by the addition of a salt. In other words, this is because a reduction in the solubility of a nonionic surfactant promotes micelle formation. The reduction degree of the cloud point varies with the type of a nonionic surfactant, and thus the amount of the salt depends on the type of the nonionic surfactant contained in the treatment liquid and is such an amount that the cloud point of the treatment liquid is reduced in accordance with an intended degree of the cloud point reduction effect. For example, if a treatment liquid containing F444 as the surfactant has a salt concentration of 5 to 10% by mass, the cloud point is reduced from 80° C. to 70° C. By adding a salt to the aqueous cleaning liquid so that the treatment liquid left on the intermediate transfer member will have such a salt concentration range, the treatment temperature in the cleaning step can be reduced.

Application Unit of Aqueous Cleaning Liquid

As the method of applying the aqueous cleaning liquid to the intermediate transfer member, conventionally known various methods can be used. Examples of the application method include die coating, blade coating, methods using gravure rollers, methods using offset rollers and spray coating. A method of applying the aqueous cleaning liquid by an ink jet method is also preferred. A combination of a plurality of methods is also particularly preferred.

The application amount of the aqueous cleaning liquid to the intermediate transfer member is set so as to give a cleaning effect and a liquid removal effect from the intermediate transfer member after the application of the aqueous cleaning liquid. From such viewpoints, the application amount can be set so that the ratio of (a) the treatment liquid coating amount to the intermediate transfer member per unit area to (b) the aqueous cleaning liquid application amount per unit area, a:b, is 1:1 to 1.2 and preferably 1:1, for example.

Removal Unit of Liquid Mixture of Water-Containing Liquid and Treatment Liquid

The cleaning unit of the intermediate transfer member can be composed of an application unit of the aqueous cleaning liquid to the intermediate transfer member and a removal unit of the aqueous cleaning liquid from the intermediate transfer member. The removal unit of the aqueous cleaning liquid from the intermediate transfer member is exemplified by a wiping unit and an ultrasonic cleaner. The wiping unit can be composed of a wiping member such as a wiper, a porous member, and a fabric member and a wiping member holder and/or a driving member for bringing the wiping member into contact with a cleaning surface of the intermediate transfer member to wipe the surface. A scraping method using a wiper can be exemplified by blade wiping by using a blade for the cleaning surface to which a cleaning liquid for the intermediate transfer member is applied to physically scrape the remainder, wet blade wiping by applying an aqueous cleaning liquid to a blade to physically scrape a remainder together with the aqueous cleaning liquid, and a combination method of them.

EXAMPLES

The present invention will next be described in further detail with reference to examples of the transfer-type image recording method of the present invention. The present invention is not intended to be limited to the following examples without departing from the scope of the invention. In the following description, "part" and "%" are based on mass unless otherwise noted.

By using a transfer-type ink jet image recording apparatus having the structure shown in FIG. 1, images were recorded, and the intermediate transfer member was cleaned.

To the surface of a 0.5 mm transparent PET film, a silicone rubber KE12 having a rubber hardness of 40° and a thickness of 0.1 mm (manufactured by Shin-Etsu Chemical Co., Ltd.) was laminated through a double-sided adhesive tape to give a surface layer member having a two-layer structure. The surface layer member was placed on the peripheral surface of a cylindrical-shaped support member made of stainless steel to prepare an intermediate transfer member.

Before the placement on the support member, the surface on the surface layer member of the intermediate transfer member was subjected to hydrophilization treatment by using a parallel flat plate type atmospheric pressure plasma treatment apparatus APT-203 (manufactured by SEKISUI CHEMICAL CO., LTD.) in the following conditions.

Surface Hydrophilization Conditions

Gas used: nitrogen gas ($N_2$)
Flow rate: 6,000 cc/min
Flow rate of air: 1,000 cc/min
Input voltage: 230 V
Treatment speed: 20 sec/cm$^2$ A treatment liquid 1 was prepared as follows: the components were mixed in accordance with the following formulation and thoroughly stirred; and then the mixture was subjected to pressure filtration through a microfilter with a pore size of 3.0 μm (manufactured by Fujifilm Corporation), giving the treatment liquid 1.

Formulation of Treatment Liquid 1

Citric acid 30.0%
Potassium hydroxide 5.0%
Glycerol 20.0%
TF2066 (manufactured by Dainippon Ink and Chemicals, Inc.) 5.0%
Pure water 40.0%

The treatment liquid 1 was put in a sealed cell capable of controlling temperature and having a thickness of 10 mm in the measurement light transmitting direction, and the transmittance was measured by using a spectrophotometer U-3900 (manufactured by Hitachi High-Technologies Corporation) adjusted at a wavelength of 570 mm. The temperature at which the transmittance was 50% or less was determined as the cloud point of the treatment liquid 1. As a result, the cloud point (Tc1) of the treatment liquid 1 was 50° C.

To apply the treatment liquid to the intermediate transfer member, a roller-type coating apparatus was used, and the treatment liquid was applied at a coating amount of 1 g/m$^2$ so that the treatment liquid applied to the image formation surface on the intermediate transfer member had a temperature (T1) of 40° C. T1 was measured with an infrared noncontact thermometer at a position immediately after the application of the treatment liquid.

To form an intermediate image after the treatment liquid coating, an aqueous pigment ink was used, and to apply the ink to the image formation surface of the intermediate transfer member, an ink jet recording apparatus was used. The ink jet recording apparatus was a device including an electrothermal conversion element and ejecting an ink on demand, and included a recording head having a large number of ejection orifices that were arranged substantially orthogonal to a conveyance direction of the intermediate transfer member across the width of the image formation surface of the intermediate transfer member. In the example, a single recording head was installed for image evaluation. If a color image is recorded, a plurality of recording heads corresponding to a plurality of colors are arranged in such a way that the ejection orifice line of each recording head is substantially parallel with a convey direction of the intermediate transfer member.

An aqueous pigment ink was prepared as follows.

Preparation of Aqueous Pigment Ink

Preparation of Black Pigment Dispersion Liquid

First, 10% of carbon black (product name: Monarch 1100, manufactured by Cabot Corporation), 15% of an aqueous solution of a pigment dispersant (a styrene-ethyl acrylate-acrylic acid copolymer with an acid value of 150 and a weight average molecular weight of 8,000; a solid content of 20%; neutralized with potassium hydroxide), and 75% of pure water were mixed. The mixture was placed in a batch type vertical sand mill (manufactured by Aimex Co.), and 200% of 0.3 mm zirconia beads were placed. The mixture was dispersed for 5 hours while being cooled with water. The dispersion liquid was subjected to a centrifuge separator to remove coarse particles, giving a black pigment dispersion liquid having a pigment concentration of about 10%.

Preparation of Resin Particle Dispersion

First, 18% of butyl methacrylate, 2% of 2,2'-azobis-(2-methylbutyronitrile), and 2% of n-hexadecane were mixed and stirred for 0.5 hour. The liquid mixture was added dropwise to 78% of a 6% aqueous solution of NIKKOL BC15 (manufactured by Nikko Chemicals Co.) as an emulsifier, and the resulting mixture was stirred for 0.5 hour. Next, the mixture was sonicated with a sonicator for 3 hours. Subsequently, the mixture was polymerized under a nitrogen atmosphere at 80° C. for 4 hours. The reaction mixture was cooled to room temperature and then filtered, giving a resin particle dispersion having a concentration of about 20%. The resin particles had a weight average molecular weight of about (1,000 to 2,000,000) and a dispersion particle diameter of about 100 nm to 500 nm.

Preparation of Aqueous Pigment Ink

In accordance with the following formulation, an aqueous pigment black ink was prepared. Specifically, the components were mixed in accordance with the following formulation and thoroughly stirred. The mixture was then subjected to pressure filtration through a microfilter with a pore size of 3.0 μm (manufactured by Fujifilm Corporation), giving an aqueous pigment black ink.

Formulation of Aqueous Pigment Black Ink

Black pigment dispersion liquid (a concentration of about 10%): 20.0%

The above resin particle dispersion (a concentration of about 20%): 50.0%

Glycerol: 5.0%

Diethylene glycol: 7.0%

L31 (manufactured by ADEKA Corporation): 3.0%

Pure water: 15.0%

An intermediate image was formed at a recording dot resolution of 1,200 dpi.

Then, a roller type transfer unit was used to transfer the intermediate image to a recording medium at a pressure of 10 kg/cm$^2$ with respect to the intermediate image, a transfer roller temperature of 60° C., and a transfer time (contact time of the recording medium and the intermediate transfer member) of 900 ms. At this transfer, the recording medium used was AURORA COAT (a ream weight of 127.9 g/m$^2$, manufactured by NIPPON PAPER INDUSTRIES Co.). When the treatment liquid 1 and the AURORA COAT were used, the treatment liquid was markedly left after the transfer.

Next, to clean the image formation surface of the intermediate transfer member after the transfer of the intermediate image, a cleaning unit including a spray coater and a blade wiper was used to perform the following cleaning treatment.

First, water as the aqueous cleaning liquid was applied to a cleaning surface of the intermediate transfer member by spray coating. At this coating, the application amount was 1 g/m$^2$. After the application of the aqueous cleaning liquid, the remainder on the intermediate transfer member was removed by blade wiping. As the wiping blade, a silicone rubber member having a rubber hardness of 60 degrees was used. The contact pressure of the wiping blade was 5 gf/mm and the contact angle was 60 degrees.

As the aqueous cleaning liquid, water with a temperature (T3) of 55° C. was used so that the liquid mixture of the remaining treatment liquid and the cleaning water had a temperature (T2) of 55° C. on the image formation surface of the intermediate transfer member.

In this example, as the unit to make the treatment liquid on the intermediate transfer member have a temperature at the time of cleaning higher than that at the time of treatment liquid coating, a xenon flash lamp L2187 (manufactured by Hamamatsu Photonics Co.) for flash-heating the intermediate transfer member itself was used to heat the intermediate transfer member to an intended temperature.

With a spiral cooler KSC200A (manufactured by ORION Co.) as a cooler placed between the cleaning unit and the roller type treatment liquid coating unit, the image formation surface of the intermediate transfer member that had been heated at the time of cleaning was cooled to adjust the temperature at the time of treatment liquid coating to an intended temperature.

The temperatures of liquids such as the treatment liquid and the liquid mixture of the treatment liquid and the aqueous cleaning liquid on the intermediate transfer member were measured by using an infrared thermograph H2640 (manufactured by Nippon Avionics Co., Ltd.).

Examples 2 to 5, Comparative Examples 1 to 3

In Examples 2 to 5 and Comparative Examples 1 to 3, image recording and cleaning of the intermediate transfer member were performed in the same manner as in Example 1 except that each treatment was performed in the conditions shown in Table 1.

A treatment liquid 2 was prepared as follows: the components were mixed in accordance with the following formulation and thoroughly stirred; and then the mixture was subjected to pressure filtration through a microfilter with a pore size of 3.0 μm (manufactured by Fujifilm Corporation), giving the treatment liquid 2. The cloud point of the treatment liquid 2 determined in the same manner as in Example 1 was 80° C.

Formulation of Treatment Liquid 2

Citric acid: 30.0%

Potassium hydroxide: 5.0%

Glycerol: 20.0%

F444 (manufactured by Dainippon Ink and Chemicals, Inc.): 5.0%

Pure water: 40.0%

The formulation of the aqueous salt solution used as the aqueous cleaning liquid in Example 5 was as shown below.

Formulation of aqueous salt solution

Potassium dihydrogen phosphate: 10%

Pure water: 90%

In Example 5, when the salt-containing water was applied at 1 g/m$^2$ to the treatment liquid 2 left on the intermediate transfer member, a liquid mixture of the remaining treatment liquid 2 and the aqueous salt solution had a salt concentration of about 5 to 10%, and the cloud point of the liquid mixture was reduced from 80° C., which was the cloud point when water was used, to 70° C.

In Example 2, a cleaning water at 60° C. was used so that the liquid mixture of the remaining treatment liquid and the cleaning water had a temperature of 60° C.

In Examples 3 to 5 and Comparative Example 3, the temperature of the liquid mixture of the remaining treatment liquid and the aqueous cleaning liquid was adjusted to a predetermined temperature by heating with a heater and a heating unit of the transfer roller.

In Comparative Examples 1 and 2, water as the aqueous cleaning liquid was not applied, and cleaning was performed only by blade wiping.

TABLE 1

| | treatment liquid | Tc1 | T1 | Aqueous cleaning liquid Component | T3 | Tc2 | T2 |
|---|---|---|---|---|---|---|---|
| Example 1 | treatment liquid 1 | 50° C. | 40° C. | Water | 55° C. | 50° C. | 55° C. |
| Example 2 | treatment liquid 1 | 50° C. | 40° C. | Water | 60° C. | 50° C. | 60° C. |
| Example 3 | treatment liquid 2 | 80° C. | 60° C. | Water | 25° C. | 80° C. | 85° C. |
| Example 4 | treatment liquid 2 | 80° C. | 60° C. | Water | 25° C. | 80° C. | 90° C. |
| Example 5 | treatment liquid 2 | 80° C. | 60° C. | Aq. salt solution | 25° C. | 70° C. | 80° C. |
| Comp. Example 1 | treatment liquid 1 | 50° C. | 60° C. | N.A. (Wiping only) | — | — | 80° C. |
| Comp. Example 2 | treatment liquid 2 | 80° C. | 60° C. | N.A. (Wiping only) | — | — | 60° C. |
| Comp. Example 3 | treatment liquid 2 | 80° C. | 60° C. | Water | 25° C. | 80° C. | 60° C. |

Tc1: Cloud point of the treatment liquid

T1: Temperature of the treatment liquid applied to the image formation surface of the intermediate transfer member Tc2: Cloud point of the liquid mixture of the remainder of the treatment liquid and the aqueous cleaning liquid T2: Temperature of the liquid mixture of the treatment liquid and the aqueous cleaning liquid formed on the image formation surface of the intermediate transfer member T3: Temperature of the aqueous cleaning liquid Evaluation of Coatability of Treatment Liquid and Cleanability In the conditions of each of Examples and Comparative Examples, the effects of treatment liquid coatability and cleanability were quantitatively compared.

As for the effects of treatment liquid coatability and cleanability, ink dots were formed on the applied treatment liquid, and the effects were evaluated on the basis of variation rates in dot size.

If the coatability of a treatment liquid varies, the amount of the treatment liquid varies on the intermediate transfer member. Thus, the reactivity of impact dots of an ink varies depending on places on the transfer member, and the dot size varies.

Depending on a cleaning condition, even if a treatment liquid is applied once again after cleaning and dots are formed, the amount of the treatment liquid varies on the intermediate transfer member, and the dot size varies as with the above.

The variation rate in ink dot size after the initial treatment liquid coating before cleaning and the variation rate when performing the treatment liquid coating in the second cycle after a series of steps including treatment liquid coating, image formation, transfer and cleaning steps to form ink dots were evaluated.

To calculate the variation rate, 30 ink dots were formed, then the average size was calculated from the 30 dots, and the difference between the average size and the most deviated dot size was indicated by percent. The results are shown in Table 2.

Variation Rate of Single Dot Size

5% or less: A

More than 5% and less than 15%: B

15% or more: C

TABLE 2

| | Dot size variation after initial treatment liquid coating | Dot size variation after treatment liquid coating in 2nd cycle |
|---|---|---|
| Example 1 | A | B |
| Example 2 | A | A |
| Example 3 | A | B |
| Example 4 | A | A |
| Example 5 | A | A |
| Comp. Example 1 | C | C |
| Comp. Example 2 | A | C |
| Comp. Example 3 | A | C |

The results reveal that by setting the temperature of the treatment liquid to a temperature lower than the cloud point of the treatment liquid at the time of treatment liquid coating, good treatment liquid coating was able to be performed, and the ink dot sizes were more stable.

At the time of cleaning, by setting the temperature of the liquid mixture of the remaining treatment liquid and the water-containing liquid to a temperature higher than the cloud point of the liquid mixture, better cleaning was able to be performed. As a result, it is revealed that even if the intermediate transfer member after cleaning is coated with the treatment liquid once again and ink dots are formed, better coating can be performed, and the ink dot sizes are more stable. In addition, as for the temperature of the liquid mixture at the time of cleaning, by setting the temperature of the mixture to a temperature 10° C. or more higher than the cloud point of the liquid mixture, marked cleanability can be achieved. It is revealed that even if the intermediate transfer member after cleaning is coated with the treatment liquid once again and ink dots are formed, the stability of ink dot sizes is excellent.

It is revealed that a salt-containing water, which has a cloud point reduction effect, has better cleanability even if the cloud point of the treatment liquid at the time of treatment liquid coating is substantially the same as the temperature of the liquid mixture on the transfer member at the time of the cleaning step, and both the coatability of a treatment liquid and the cleanability can be achieved.

As described above, it is revealed that by using the present invention in a transfer-type ink jet recording method, good coatability of a treatment liquid and cleanability can be achieved without adding other steps such as the formation of a release layer on an intermediate transfer member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-099776, filed May 15, 2015, which is hereby incorporated by reference herein in its entirety.

What is claimed is:

1. A transfer-type image recording method comprising the steps of:

applying a treatment liquid that causes aggregation of a component contained in an ink to an image formation surface of an intermediate transfer member;

applying an ink to the image formation surface to which the treatment liquid is applied to form an intermediate image;

transferring the intermediate image from the image formation surface to an recording medium; and applying an aqueous cleaning liquid to the image formation surface after the transfer of the intermediate image, wherein the treatment liquid contains a nonionic surfactant, wherein in the step of applying a treatment liquid, the following Expression (1) is satisfied:

$$T1<Tc1 \quad (1)$$

where T1 is a temperature of the treatment liquid applied to the image formation surface, and Tc1 is a cloud point of the treatment liquid, and wherein in the step of applying an aqueous cleaning liquid, the following Expression (2) is satisfied:

$$T2>Tc2 \quad (2)$$

where T2 is a temperature of a liquid mixture, formed on the image formation surface, of a remainder of the treatment liquid and the aqueous cleaning liquid, and Tc2 is a cloud point of the liquid mixture.

2. The transfer-type image recording method according to claim 1, wherein temperature conditions satisfying Expression (1) and Expression (2) are formed by temperature control of the image formation surface.

3. The transfer-type image recording method according to claim 2, wherein the temperature control includes at least one of cooling and heating.

4. The transfer-type image recording method according to claim 1, wherein the following Expression (3) is satisfied:

$$T3>Tc1 \quad (3)$$

where T3 is a temperature of the aqueous cleaning liquid, and Tc1 is a cloud point of the treatment liquid.

5. The transfer-type image recording method according to claim 4, wherein a temperature condition satisfying Expression (3) is formed by temperature control of the image formation surface.

6. The transfer-type image recording method according to claim 1, wherein T2 and Tc2 satisfy $T2-Tc2 \geq 10°$ C.

7. The transfer-type image recording method according to claim 1, wherein at least one of the treatment liquid and the ink is applied to the image formation surface by an ink jet method.

* * * * *